US008731221B2

(12) United States Patent
Ura

(10) Patent No.: US 8,731,221 B2
(45) Date of Patent: May 20, 2014

(54) HEARING AID

(75) Inventor: Takefumi Ura, Kanagawa (JP)

(73) Assignee: Panasonic Corporation, Osaka (JP)

( * ) Notice: Subject to any disclaimer, the term of this patent is extended or adjusted under 35 U.S.C. 154(b) by 319 days.

(21) Appl. No.: 13/003,369

(22) PCT Filed: Jul. 10, 2009

(86) PCT No.: PCT/JP2009/003258
§ 371 (c)(1),
(2), (4) Date: Jan. 10, 2011

(87) PCT Pub. No.: WO2010/004769
PCT Pub. Date: Jan. 14, 2010

(65) Prior Publication Data

US 2011/0135128 A1 Jun. 9, 2011

(30) Foreign Application Priority Data

Jul. 11, 2008 (JP) ..... P2008-181735

(51) Int. Cl.
*H04R 25/00* (2006.01)
*H04H 40/54* (2008.01)

(52) U.S. Cl.
USPC ..... 381/315; 381/312; 381/23.1; 381/7

(58) Field of Classification Search
USPC ..... 381/57, 56, 59, 19, 17, 1, 312, 314, 381/322, 328, 330, 60, 55
See application file for complete search history.

(56) References Cited

U.S. PATENT DOCUMENTS

| | | | | |
|---|---|---|---|---|
| 5,721,783 | A | 2/1998 | Anderson | |
| 5,867,581 | A | 2/1999 | Obara | |
| 7,274,794 | B1 * | 9/2007 | Rasmussen | 381/92 |
| 7,286,673 | B2 * | 10/2007 | Bindner et al. | 381/60 |
| 7,616,767 | B2 * | 11/2009 | Geiger et al. | 381/57 |
| 8,005,248 | B1 * | 8/2011 | Davant | 381/324 |
| 8,055,000 | B2 * | 11/2011 | Ludvigsen | 381/312 |
| 8,175,305 | B2 * | 5/2012 | Chew et al. | 381/312 |
| 8,199,919 | B2 * | 6/2012 | Goldstein et al. | 381/56 |
| 2009/0257608 | A1 * | 10/2009 | Chew et al. | 381/312 |

FOREIGN PATENT DOCUMENTS

| | | | |
|---|---|---|---|
| JP | 08-294197 | A | 11/1996 |
| JP | 11-511301 | A | 9/1999 |
| JP | 11-296765 | A | 10/1999 |
| JP | 2000-032167 | A | 1/2000 |

(Continued)

OTHER PUBLICATIONS

International Search Report for PCT/JP2009/003258 dated Sep. 29, 2009.

*Primary Examiner* — Davetta W Goins
*Assistant Examiner* — Raffi Isanians
(74) *Attorney, Agent, or Firm* — Wenderoth, Lind & Ponack, L.L.P.

(57) ABSTRACT

There is provided a hearing aid that reduces a possibility of loss. The hearing aid of the present invention includes a microphone 101 configured to collect sound; a hearing aid processing unit 102 configured to perform hearing aid processing to an input signal from the microphone 101; a speaker 103 configured to output a signal processed by the hearing aid processing unit 102 to the outside; and a drop detection unit 104 configured to detect drop by reference to the input signal from the microphone 101.

6 Claims, 5 Drawing Sheets

(56) References Cited

FOREIGN PATENT DOCUMENTS

| | | | | | |
|---|---|---|---|---|---|
| JP | 2000-325233 | A | | 11/2000 | |
| JP | 2001-145198 | A | | 5/2001 | |
| JP | 2001145198 | A | * | 5/2001 | ..... H04R 25/00 |
| JP | 2007-124022 | A | | 5/2007 | |

* cited by examiner

HEARING AID

TECHNICAL FIELD

The present invention relates to a hearing aid and, more particularly, to a hearing aid that reduces the possibility of loss.

BACKGROUND ART

As a hearing aid that reduces the possibility of loss, there has been proposed a hearing aid including a cord attached to a main body of the hearing aid (see, for example, Patent Document 1).

FIG. 10 shows the hearing aid described in Patent Document 1. The hearing aid includes an ear hole insert unit 801 used for inserting and attaching the hearing aid into an ear hole; a main body 802 in which a microphone (not shown), a speaker, a battery, and others, are built; a cord 803; and a connection portion 804 for connecting the main body 802 to the cord 803.

As shown in FIG. 10, the art hearing aid includes the cord 803 joined to the main body 802. For example, the hearing aid is fastened to clothes put on a user by attaching a strap to the cord 803, or the user wears the strap on his/her neck to thus keep the hearing aid on him/her. Consequently, the loss of the hearing aid is avoided.

RELATED ART DOCUMENT

Patent Document

Patent Document 1: JP-A-2007-124022

DISCLOSURE OF THE INVENTION

Problem to be Solved by the Invention

However, the art hearing aid has to be always physically connected to something by the cord 803 so as not to be easily lost. Therefore, the hearing aid raises a problem of giving inconvenience to the user. The hearing aid also has a problem of the possibility that the hearing aid may be lost when erroneously dropped while another item, such as a strap, is attached to the cord 803.

The object of the present invention is to provide a hearing aid that can reduce the possibility of loss without giving inconvenience to the user when compared with the related art hearing aid.

Means for Solving the Problem

The present invention provides a hearing aid comprising: a microphone; a hearing aid processing unit configured to perform hearing aid processing to a signal corresponding to sound collected by the microphone, and produce an output signal; a speaker configured to output sound generated from the output signal to an outside; and a drop detection unit configured to analyze a characteristic of the signal corresponding to the sound collected by the microphone, and detect drop of the hearing aid.

By the configuration, the hearing aid of the present invention is not required to additionally include a dedicated sensor, and can detect a drop that results in a loss by use of the signal corresponding to the sound collected by the microphone.

In the hearing aid, the drop detection unit comprises an impulsive sound detection unit configured to detect impulsive sound caused by the drop of the hearing aid via the microphone, and a audio feedback detection unit that detects audio feedback sound caused by the microphone and the speaker; and the drop detection unit analyzes a signal of the impulsive sound detected by the impulsive sound detection unit and a signal of audio feedback detected by the audio feedback detection unit, and detects the drop of the hearing aid.

By the configuration, the hearing aid of the present invention is not required to additionally include a dedicated sensor and can detect the drop of the hearing aid with superior accuracy by analysis of impulsive sound and audio feedback sound.

In the hearing aid, the drop detection unit comprises a drop determination unit configured to determine whether the hearing aid is dropped, based on a relationship between a detection time of the impulsive sound detected by the impulsive sound detection unit and a detection time of the audio feedback detected by the audio feedback detection unit.

By the configuration, the hearing aid of the present invention is not required to additionally include a dedicated sensor and can detect the drop of the hearing aid based on the relationship between the impulsive sound detection time and the audio feedback sound detection time.

The hearing aid comprises a plurality of microphones, and the drop detection unit comprises a directivity synthesis unit configured to perform directivity synthesis processing to a signal of impulsive sound collected by the plurality of microphones.

By the configuration, the hearing aid of the present invention enhances impulsive sound by directivity synthesis processing, thereby facilitating detection of impulsive sound.

In the hearing aid, the hearing aid processing unit produces warning sound from the signal of audio feedback when the drop detection unit detects the drop of the hearing aid.

By the configuration, the hearing aid of the present invention is not required to additionally include notification means and can notify the user of the drop of the hearing aid.

In the hearing aid, the hearing aid processing unit amplifies a gain of audio feedback.

By the configuration, the hearing aid of the present invention can enhance a directional sense of warning sound for notifying the user of the drop of the hearing aid.

In the hearing aid, the hearing aid processing unit changes the gain of audio feedback with elapse of time.

By the configuration, the hearing aid of the present invention can enhance a directional sense of warning sound for notifying the user of the drop of the hearing aid.

The hearing aid further comprises a notification unit configured to notify a user of the drop of the hearing aid according to a detection result of the drop detection unit.

By the configuration, the hearing aid of the present invention can notify the user of the drop of the hearing aid.

In the hearing aid, the notification unit notifies the user of the drop of the hearing aid via the speaker.

By means of the configuration, the hearing aid of the present invention can allow the user to recognize the drop of the hearing aid by sound.

In the hearing aid, the notification unit notifies the user of the drop of the hearing aid by light.

By the configuration, the hearing aid of the present invention can allow the user to recognize a drop of the hearing aid by light.

In the hearing aid, the notification unit notifies the user of the drop of the hearing aid by vibrations.

By the configuration, the hearing aid of the present invention can allow the user to recognize a drop of the hearing aid by means of vibrations.

The hearing aid further comprises a communication unit configured to transmit the drop of the hearing aid to another device according to a detection result of the drop detection unit.

By means of the configuration, the hearing aid of the present invention can allow the user to recognize the drop of the hearing aid via another device.

Advantages of the Invention

When compared with a related art hearing aid, the hearing aid of the present invention provides an advantage of reducing the possibility of loss without imposing inconvenience on a user by means of detecting a drop of the hearing aid by use of warning sound and notifying the user of the drop.

MODE FOR CARRYING OUT THE INVENTION

Embodiments of the present invention are hereinafter described with reference to the drawings.

First Embodiment

Figure 1:
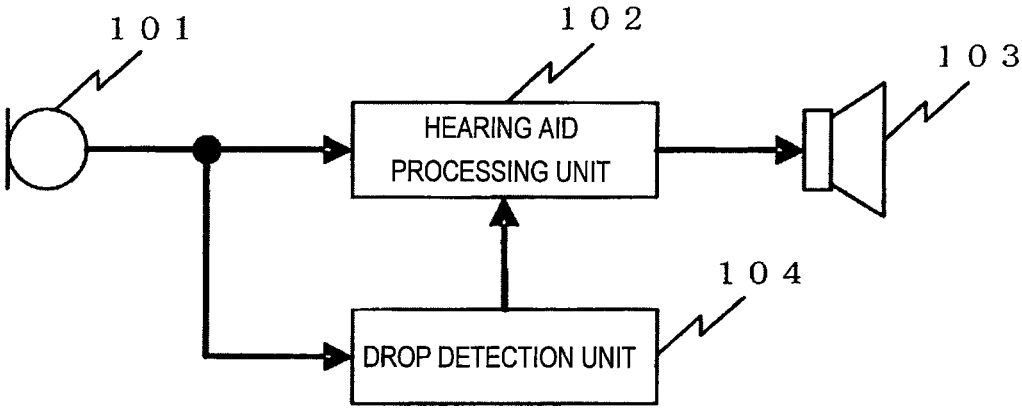
FIG. 1 is a block diagram of a hearing aid of a first embodiment of the present invention.

FIG. 1 is a block diagram of a hearing aid of a first embodiment of the present invention. The hearing aid of the present embodiment includes: a microphone 101 configured to collect sound; a hearing aid processing unit 102 configured to subject a signal input to the microphone 101 to hearing aid processing; a speaker 103 configured to output a signal processed by the hearing aid processing unit 102 to the outside; and a drop detection unit 104 configured to detect drop by reference to the signal input to the microphone 101.

Figure 2:
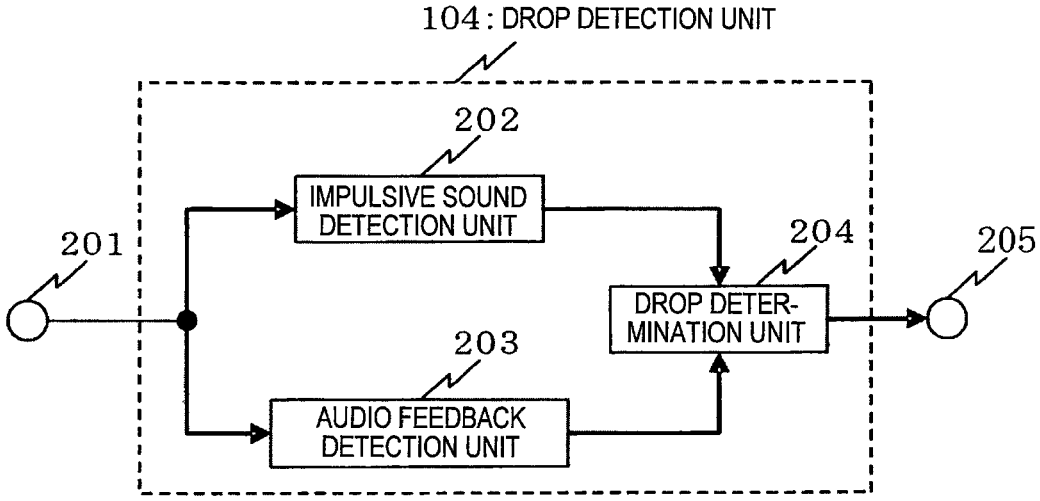
FIG. 2 is a block diagram of a drop detection unit constituting the hearing aid of the first embodiment of the present invention.

FIG. 2 is a block diagram of the drop detection unit 104 constituting the hearing aid of the first embodiment of the present invention. By reference to FIG. 2, the drop detection unit 104 includes: an input terminal 201 into which a signal is input from the microphone 101; an impulsive sound detection unit 202 configured to impulsive sound; a audio feedback detection unit 203 configured to detect occurrence of audio feedback; a drop determination unit 204 configured to determine occurrence of drop according to detection results produced by the impulsive sound detection unit 202 and the audio feedback detection unit 203; and an output terminal 205 configured to output a determination result produced by the drop determination unit 204.

Operation of the hearing aid of the first embodiment of the present invention is now described. The hearing aid of the present embodiment is of a so-called integral-type including a speaker and a microphone both of which are mounted in a single housing and is fitted into an ear. The hearing aid processing unit 102 includes gain control processing.

The hearing aid processing unit 102 subjects an input signal corresponding to the sound collected by the microphone 101 to amplification processing, or the like, thereby generating an output signal. Subsequently, the output signal is output as sound to the outside from the speaker 103. The drop detection unit 104 detects drop of the hearing aid by reference to the input signal of the microphone 101.

In normal times, when a user wears the hearing aid, an amount of amplified sound that is output from the speaker 103 and returns to the microphone 101 is small. However, when the hearing aid has slipped out of the ear, the amount of sound returning from the speaker 103 to the microphone 101 increases. In such a case, acoustic coupling between the microphone and the speaker causes audio feedback. Occurrence of audio feedback is a phenomenon that should particularly be concerned in connection with the hearing aid which includes the speaker and the microphone spaced apart from each other by a short distance and which also functionally amplifies a signal much greater.

Accordingly, in the first embodiment of the present invention, the drop detection unit 104 detects drop of the hearing aid by means of detecting impulsive sound resulting from drop of the hearing aid as well as sound of the phenomenon (audio feedback) unique to such a hearing aid.

<Flow of a Signal Input from the Input Terminal 201>

A flow of a signal input from the input terminal 201 is described by reference to FIG. 2.

First, the signal input to the input terminal 201 is input to the impulsive sound detection unit 202 and the audio feedback detection unit 203, respectively.

Figure 11:
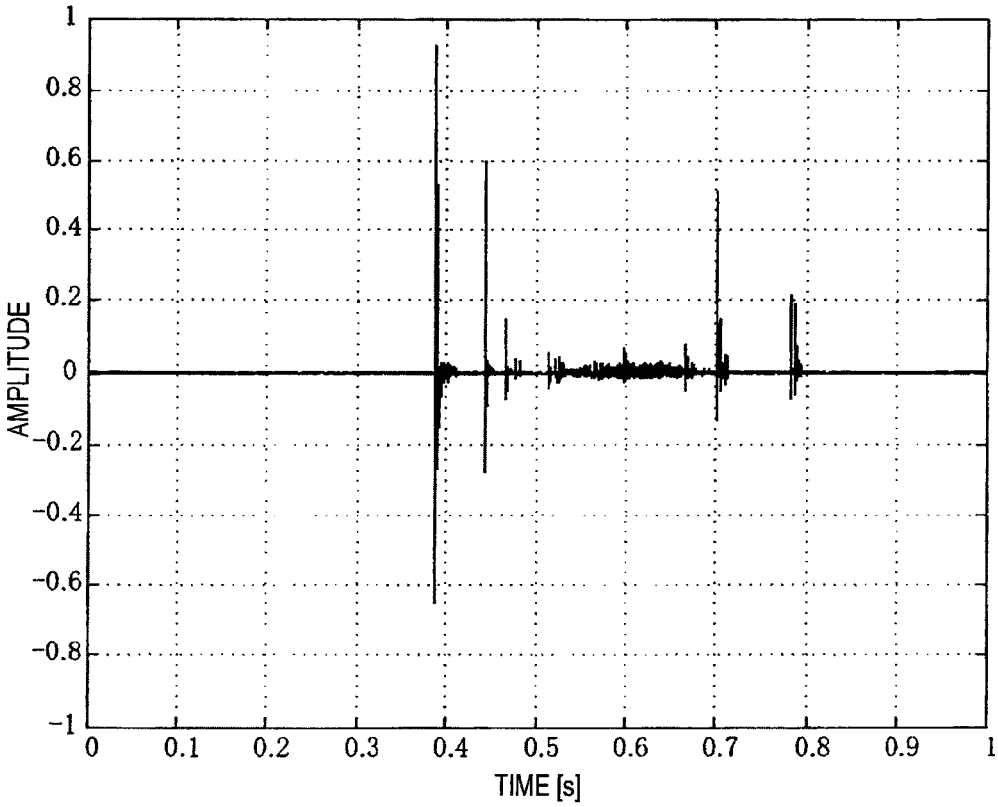
FIG. 11 is an example waveform of a signal showing impulsive sound by the drop of the hearing aid.

The impulsive sound detection unit 202 calculates, for example, an envelope of an absolute level of an input signal, and monitors presence or absence of a signal showing a large absolute level, or the like, by use of known means, thereby detecting impulsive sound. FIG. 11 shows an example waveform of a signal showing impulsive sound resulting from drop of the hearing aid. The waveform has a feature in which a signal instantaneously rises high (to a level of about 0.39 [s]) due to physical impact by the drop. The impulsive sound detection unit 202 detects, for example, the feature of the waveform.

Figure 12:
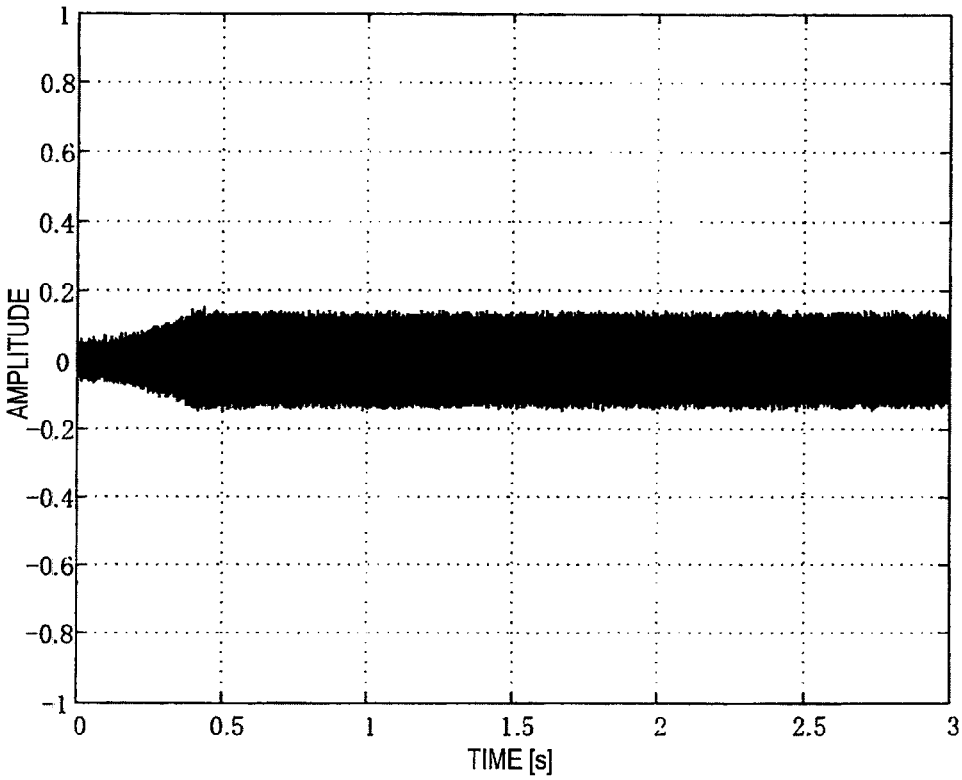
FIG. 12 is an example waveform of a signal of audio feedback caused by a microphone 101 and a speaker 103.

The audio feedback detection unit 203 detects audio feedback by use of known means, for example, monitoring of presence/absence of a frequency showing a peak by continual analysis of a frequency of an input signal. FIG. 12 shows an example waveform of a signal of audio feedback caused by the microphone 101 and the speaker 103. The waveform has a feature in which the waveform is a sine-wave signal and in which the frequency showing a peak continues in time dimension. The audio feedback detection unit 203 detects, for example, a characteristic of the waveform.

Now, the drop determination unit 204 detects from, for example, detection results output by the impulsive sound detection unit 202 and the audio feedback detection unit 203, a time from when either impulsive sound or audio feedback sound is detected until when the other sound is detected. When the time from when impulsive sound is detected until when audio feedback sound is detected (or from when audio feedback sound is detected until when impulsive sound is detected) falls within a predetermined time, the drop determination unit 204 determines that the hearing aid has dropped.

The word "predetermined time" used herein is set to about one second according to the manner of drop of the hearing aid in a case of, for example, when the user has removed the hearing aid fitted into the ear from the ear and erroneously dropped the hearing aid directly to a ground surface, the predetermined time is set to about one second. In addition, it is possible to appropriately set the predetermined time in expectation of a situation of drop of the hearing aid.

When the drop determination unit 204 has determined that the hearing aid dropped, the hearing aid processing unit 102 amplifies a gain of audio feedback sound, thereby generating warning sound from the audio feedback sound. The warning sound generated by the hearing aid processing unit 102 is output from the speaker 103, whereby the drop of the hearing aid is reported to the user.

As mentioned above, the hearing aid of the first embodiment of the present invention detects drop of the hearing aid itself by use of the audio feedback sound and the impulsive sound and outputs the warning sound generated from the audio feedback sound from the speaker, thereby notifying the user of the drop of the hearing aid itself.

Consequently, it becomes possible to reduce the possibility of loss of the hearing aid without imposing inconvenience to the user. Moreover, in order to detect the drop of the hearing aid, the hearing aid of the first embodiment uses sound of the phenomenon (audio feedback) unique to the hearing aid as well as the impulsive sound resultant from the drop of the hearing aid. A compact, economical hearing aid can be provided without use of a dedicated sensor, such as an impact sensor and an acceleration sensor.

The hearing aid of the first embodiment of the present invention uses presence or absence of audio feedback sound as well as impulsive sound to detect drop of the hearing aid. A possibility that impulsive sound which would be generated by simply tapping a hearing aid fitted into the ear hole with a finger, or the like, may be erroneously determined to be a drop is thereby reduced; consequently, drop can be detected with superior accuracy.

In the present embodiment, the hearing aid processing unit 102 is described as a unit that amplifies a gain upon detection of drop. However, the hearing aid processing unit 102 is not limited to such operation.

For example, gain control processing of the hearing aid processing unit 102 can also be configured so as to amplify a gain of the audio feedback sound stepwise along with elapse of time when drop of the hearing aid is detected. By means of the configuration, the user hears, in an increasingly louder fashion, the warning sound originated from the audio feedback sound during the drop of the hearing aid. Therefore, the user can easily recognize drop of the hearing aid itself.

For example, gain control processing of the hearing aid processing unit 102 may also be configured in such a way that the gain of the audio feedback sound is changed in time dimension when the drop of the hearing aid is detected. By means of the configuration, the user hears the warning sound adequate to variations with time during the drop of the hearing aid; hence, the user can easily recognize the drop of the hearing aid.

For example, the hearing aid processing unit 102 may also be configured so as to perform control in such a way that the audio feedback frequency is shifted to a frequency that is easy for the user to catch. The configuration can allow the user to easily recognize the drop of the hearing aid itself.

When the hearing aid processing unit 102 includes audio feedback suppression processing, the hearing aid processing unit can also be configured so as to perform control in such a way that audio feedback suppression processing is deactivated when the drop is detected.

Figure 3:
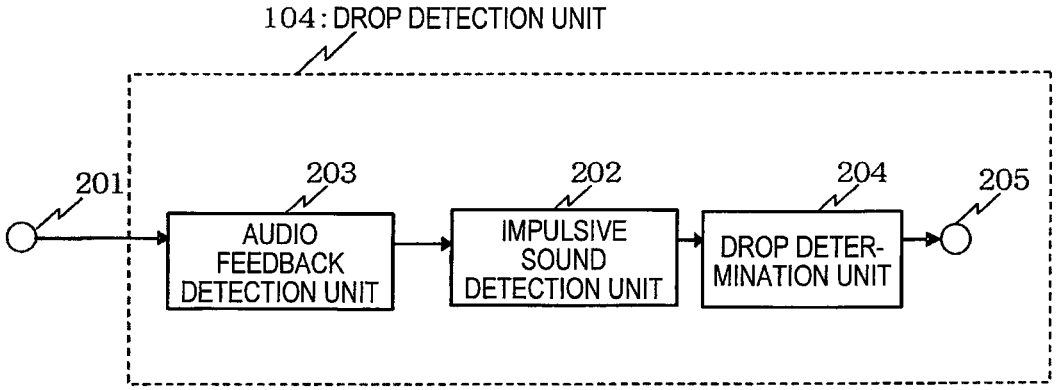
FIG. 3 is a block diagram showing a modification of the drop detection unit of the first embodiment of the present invention.

For example, as shown in FIG. 3, the drop detection unit 104 may also be configured in such a way that the impulsive sound detection unit 202 and the audio feedback detection unit 203 are connected in series. When audio feedback develops earlier than does impulsive sound, the drop detection unit 104 can also be configured in such a way that a signal input to the input terminal 201 is first input to the audio feedback detection unit 203 and subsequently to the impulsive sound detection unit 202.

The drop detection unit 104 may also be configured in such a way that, when audio feedback develops later than does impulsive sound, the signal input to the input terminal 201 is first input to the impulsive sound detection unit 202 and subsequently to the audio feedback detection unit 203.

The drop detection unit 104 described in the present embodiment refers to the input signal of the microphone 101. However, the drop detection unit may be configured to refer to an output signal from the hearing aid processing unit 102.

Second Embodiment

Figure 4:
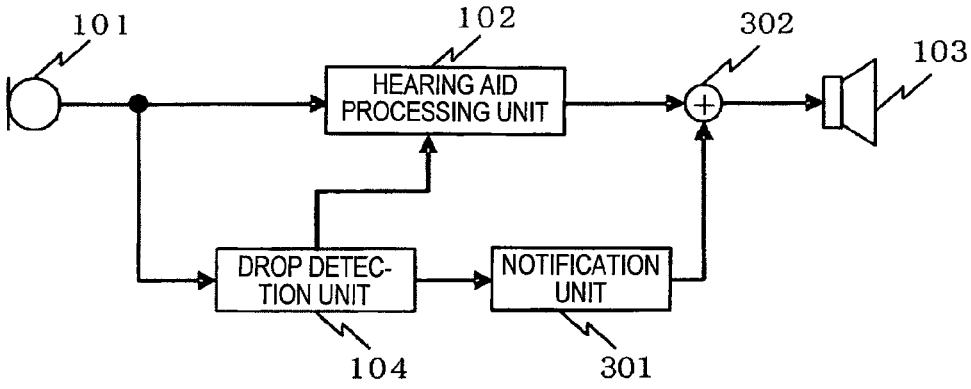
FIG. 4 is a block diagram showing a hearing aid of a second embodiment of the present invention.

FIG. 4 is a block diagram of a hearing aid of a second embodiment of the present invention. In FIG. 4, the same elements as those described by reference to FIG. 1 are assigned the same reference numerals, and their explanations are omitted. In FIG. 4, in addition to including the configuration of the hearing aid of the first embodiment of the present invention, the hearing aid of the second embodiment of the present invention includes a notification unit 301 and an adder 302.

Operation of the hearing aid of the second embodiment of the present invention is now described. Since the drop detection method of the hearing aid is the same as that described in connection with the first embodiment of the present invention, and hence their explanations are omitted. Operation of the hearing aid subsequent to detection of the drop of the hearing aid is hereinbelow described.

When the drop detection unit 104 has detected the drop of the hearing aid, a signal showing detection of the drop of the hearing aid is transmitted from the drop detection unit 104 to the hearing aid processing unit 102 and the notification unit 301. The hearing aid processing unit 102 reduces a gain of the input signal corresponding to the sound collected by the microphone 101, and the notification unit 301 outputs warning sound for notifying the drop of the hearing aid.

The warning sound output from the notification unit 301 is added to the signal output from the hearing aid processing unit 102 by the adder 302, and a result of addition is output from the speaker 103, whereby the user is notified of the drop of the hearing aid. In the second embodiment of the present invention, sound previously stored in the notification unit 103 rather than the sound generated from the audio feedback sound as in the first embodiment of the present invention is used as warning sound for notifying the user of the drop of the hearing aid.

In the present embodiment, the hearing aid processing unit 102 is described as reducing the gain when drop is detected.

However, the hearing aid processing unit 102 may also be configured not to perform any control operation when drop is detected; namely, the hearing aid processing unit may also be configured so as not to perform gain adjustment.

As mentioned above, the hearing aid of the second embodiment of the present invention detects the drop of the hearing aid itself by use of audio feedback sound and impulsive sound and outputs warning sound generated from the sound previously stored in the notification unit 301 from the speaker 103, whereby the user can be notified of the drop of the hearing aid itself.

Consequently, the possibility of loss of the hearing aid can be reduced without imposing inconvenience to the user. Further, preferred warning sound can also be set in the notification unit 301.

In order to detect the drop of the hearing aid, the hearing aid of the second embodiment of the present invention uses sound of a phenomenon (audio feedback) unique to the hearing aid in addition to using impulsive sound resultant from the drop of the hearing aid. Hence, a compact, economical hearing aid can be provided without use of a dedicated sensor, such as an impact sensor and an acceleration sensor.

The hearing aid of the second embodiment of the present invention uses presence or absence of audio feedback sound as well as impulsive sound to detect the drop of the hearing aid. A possibility that impulsive sound which would be produced by simply tapping a hearing aid fitted into the ear with a finger might be erroneously determined to be a drop is thereby reduced, so that drop can be detected with superior accuracy.

Third Embodiment

Figure 5:
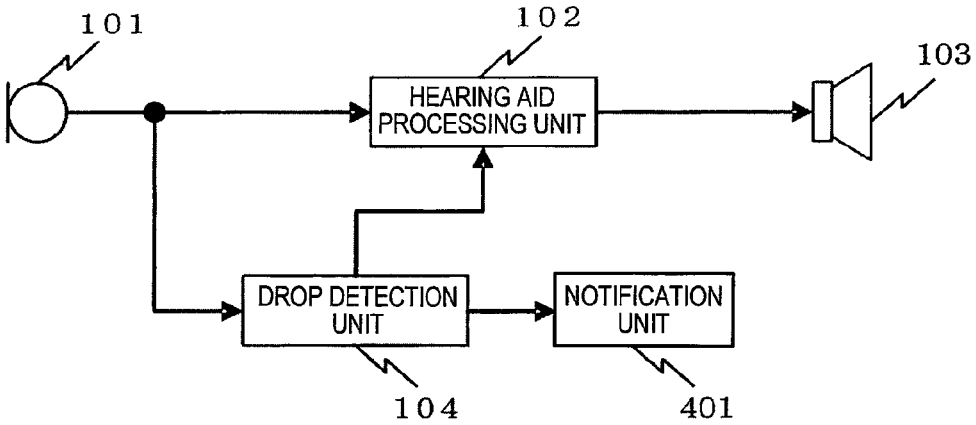
FIG. 5 is a block diagram showing a hearing aid of a third embodiment of the present invention.

FIG. 5 is a block diagram of a hearing aid of a third embodiment of the present invention. In FIG. 5, constituent elements that are identical with their counterparts described by reference to FIG. 1 are assigned the same reference numerals, and their explanations are omitted. In FIG. 5, in addition to including the configuration of the hearing aid of the first embodiment of the present invention, the hearing aid includes a notification unit 401.

Operation of the hearing aid of the third embodiment of the present invention is now described. Since the drop detection method of the hearing aid is the same as that described in connection with the first embodiment of the present invention, and hence their explanations are omitted. Operation of the hearing aid subsequent to detection of the drop of the hearing aid is hereinbelow described.

When the drop detection unit 104 has detected the drop of the hearing aid, a signal showing detection of the drop of the hearing aid is transmitted to the notification unit 401. The notification unit 401 causes vibrations, thereby notifying the user of the drop of the hearing aid by means of the vibrations. In the third embodiment of the present invention, the user is notified of the drop of the hearing aid by means of the vibrations generated by the notification unit 401 rather than the sound generated from the audio feedback sound as in the first embodiment of the present invention.

In the present embodiment, the notification unit 401 is described as notifying the drop by causing vibrations. However, there may also be adopted a configuration in which the user is notified of the drop of the hearing aid by using a light emitting element as the notification unit 401 and by utilization of illuminating operation of the light emitting element.

As mentioned above, the hearing aid of the third embodiment of the present invention can detect the drop of the hearing aid itself by use of the audio feedback sound and the impulsive sound and notify the user of the drop of the hearing aid itself by means of vibrations, light, and the like, generated by the notification unit 401. Consequently, it becomes possible to reduce the possibility of loss of the hearing aid without imposing inconvenience to the user.

In order to detect the drop of the hearing aid, the hearing aid of the third embodiment of the present invention uses sound of the phenomenon (audio feedback) unique to the hearing aid as well as the impulsive sound resultant from the drop of the hearing aid. Accordingly, a compact, economical hearing aid can be provided without use of a dedicated sensor, such as an impact sensor and an acceleration sensor.

In addition to using the impulsive sound, the hearing aid of the third embodiment of the present invention uses the presence or absence of the audio feedback sound for detecting the drop of the hearing aid. It thereby becomes possible to reduce the possibility that impulsive sound which would be generated by simply tapping the hearing aid fitted into the ear hole with a finger, or the like, might erroneously be determined to be a drop, whereby the drop can be detected with superior accuracy.

Fourth Embodiment

Figure 6:
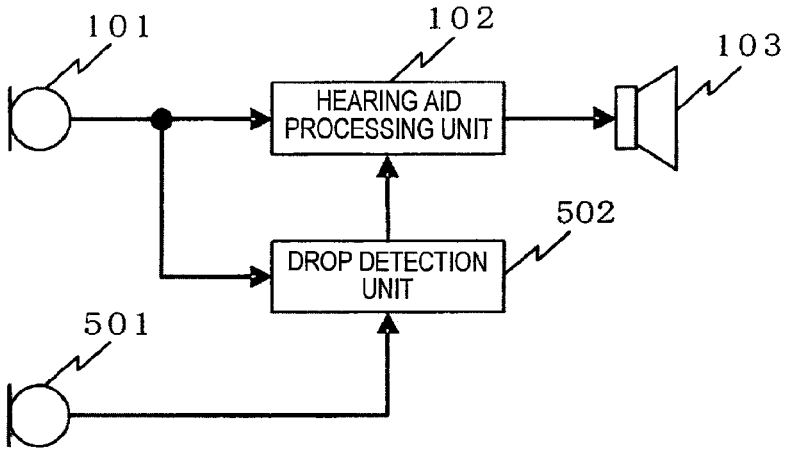
FIG. 6 is a block diagram showing a hearing aid of a fourth embodiment of the present invention.
Figure 7:
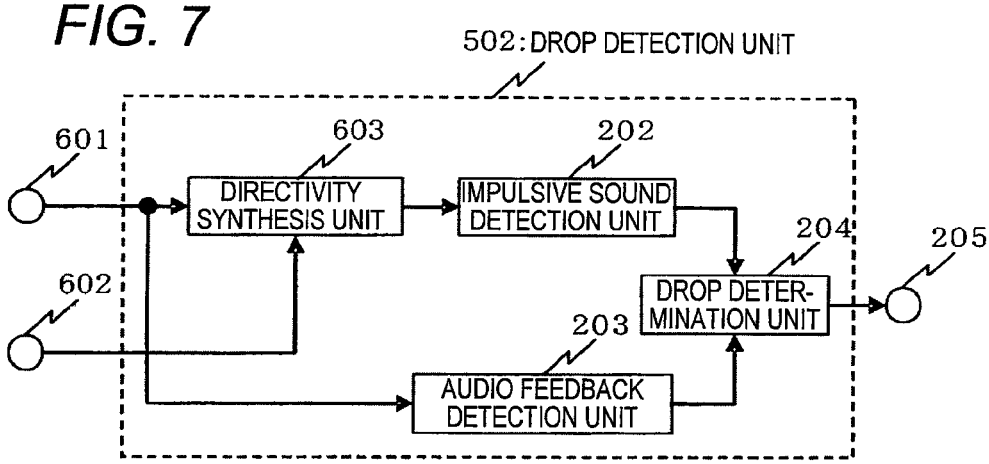
FIG. 7 is a block diagram of a drop detection unit constituting the hearing aid of the fourth embodiment of the present invention.

FIG. 6 is a block diagram of a hearing aid of a fourth embodiment of the present invention. In FIG. 6, constituent elements that are the same as those shown in FIG. 1 are assigned the same reference numerals, and their explanations are omitted. FIG. 7 is a block diagram of a drop detection unit constituting the hearing aid of the fourth embodiment of the present invention. In FIG. 7, constituent elements that are the same as those shown in FIG. 2 are assigned the same reference numerals, and their explanations are omitted.

In FIG. 6, the hearing aid of the fourth embodiment of the present invention is equipped with a drop detection unit 502 in place of the drop detection unit 104 as well as with another microphone 501 differing from the microphone 101 of the hearing aid of the first embodiment of the present invention.

In FIG. 7, the drop detection unit 502 includes an input terminal 601 into which a signal is input from the microphone 101; an input terminal 602 into which a signal is input from the microphone 501; and a directivity synthesis unit 603 that subjects the input signals of the input terminal 601 and the input terminal 602 to directivity synthesis processing.

Figure 8:
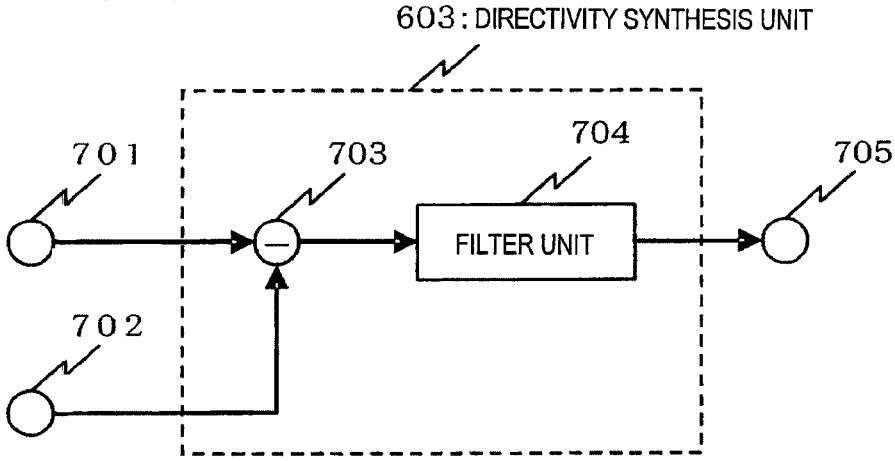
FIG. 8 is a block diagram of a directivity synthesis unit constituting the hearing aid of the fourth embodiment of the present invention.

In FIG. 8, the directivity synthesis unit 603 includes an input terminal 701 into which a signal is input from the input terminal 601; an input terminal 702 into which a signal is input from the input terminal 602; a subtractor 703 that subjects an input signal of the input terminal 701 and an input signal of an input terminal 702 to subtraction; a filter unit 704 that subjects an output signal of the subtractor 703 to filter processing; and an output terminal 705 that delivers an output signal of the filter unit 704 to the impulsive sound detection unit 202.

Operation of the hearing aid of the fourth embodiment of the present invention is now described.

In FIGS. 6 to 8, input signals corresponding to the sound collected by the microphone 101 and the microphone 501 are input to the input terminal 701 and the input terminal 702 of the directivity synthesis unit 603 by way of the input terminal 601 and the input terminal 602 of the drop detection unit 502.

The subtractor 703 subjects the input signals of the input terminal 701 and the input terminal 702 to subtraction. The filter unit 704 subjects an output signal from the subtractor 703 to frequency band limitation, to thus extract a low frequency component of the output signal of the subtractor 703, and takes the thus-extracted component as an output signal of the filter unit 704.

A series of processing operations are equivalent to directivity synthesis processing of a sound pressure gradient type that exhibits bidirectionality. In general, directivity synthesis of sound pressure gradient type is performed, sensitivity about a signal (e.g., impulsive sound, wind noise, or the like) that exhibits no correlation among a plurality of microphones is enhanced, and impulsive sound is particularly enhanced in a low frequency. Therefore, an output signal from the filter unit 704 is a signal produced as a result of the low frequency component having been extracted from an output signal from the subtractor 703, and hence impulsive sound is enhanced. As a consequence, it becomes easier to detect impulsive sound.

By reference to FIGS. 7 and 8, an output signal from the filter unit 704 is input to the impulsive sound detection unit 202 by way of the output terminal 705 of the directivity synthesis unit 603. The impulsive sound detection unit 202 detects impulsive sound resultant from drop of the hearing aid by use of the input signal whose impulsive sound has been enhanced. The audio feedback detection unit 203 detects audio feedback by means of the same method as that described in connection with the first embodiment of the present invention.

For example, from the impulsive sound detected by the impulsive sound detection unit 202 and a detection result output from the audio feedback detection unit 203, the drop determination unit 204 measures a time from when either the impulsive sound or the audio feedback sound is detected until when remaining sound is detected.

When the time from when the impulsive sound is detected until when the audio feedback sound is detected (or from when the audio feedback sound is detected until when the impulsive sound is detected) falls within a predetermined period of time, the drop determination unit 204 determines that the hearing aid dropped.

The word "predetermined time" used herein is set to about one second according to the manner of drop of the hearing aid in a case of, for example, when the user has removed the hearing aid fitted into the ear from the ear and erroneously dropped the hearing aid directly to a ground surface, the predetermined time is set to about one second. In addition, it is possible to appropriately set the predetermined time in expectation of a situation of drop of the hearing aid.

When the drop determination unit 204 determines that the hearing aid dropped, the hearing aid processing unit 102 amplifies the gain of audio feedback sound, thereby generating warning sound from the audio feedback sound. The warning sound generated by the hearing aid processing unit 102 is output from the speaker 103, whereupon the drop of the hearing aid is notified to the user.

In the present embodiment, the directivity synthesis unit 603 has been described to subject an input signal, as it is, to subtraction, thereby yielding a bi-directional characteristic. However, the hearing aid is not limited to the configuration. Any configuration is acceptable, so long as the configuration can easily detect impulsive sound by utilization of directivity synthesis processing.

For example, there may also be adopted a configuration in which a delay for correcting a relative amount of delay between the microphones may be provided in a stage subsequent to either the microphone 101 or the microphone 501 or both the microphone 101 and the microphone 501 and in which input signals of the microphones are subjected to subtraction.

The filter unit 704 has been described as limiting a band to a low frequency but is not limited to the operation. The filter unit performs any operation, so long as the operation involves filter processing for facilitating detection of impulsive sound.

It is desirable that the microphone 101 and the microphone 501 are assigned an arrangement which is easy to detect impulsive sound.

Although the microphones have been described as being used in number of two, the number of microphones is not limited to two. Even when microphones are used in number of three or more, it is better to appropriately expand the arrangement of the microphones so as to easily detect impulsive sound according to the number of microphones, thereby using directivity synthesis processing.

As mentioned above, the hearing aid of the fourth embodiment of the present invention detects the drop of the hearing aid itself by use of the audio feedback sound and the impulsive sound enhanced by directivity synthesis processing and outputs warning sound generated from the audio feedback sound from the speaker, which can notify the user of the drop of the hearing aid itself.

Therefore, it is possible to reduce the possibility of loss of the hearing aid without imposing inconvenience to the user.

The hearing aid of the fourth embodiment of the present invention detects the drop of the hearing aid by use of the impulsive sound which has been enhanced by directivity synthesis processing and which results from the drop of the hearing aid as well as sound of the phenomenon (audio feedback) unique to the hearing aid. Therefore, a compact, economical hearing aid can be provided without use of a dedicated sensor, such as an impact sensor and an acceleration sensor.

The hearing aid of the fourth embodiment of the present invention uses presence or absence of the audio feedback sound as well as the impulsive sound for detecting the drop of the hearing aid. It is thereby possible to reduce the possibility that impulsive sound which would be produced when the hearing aid fitted into the ear is tapped simply with a finger, or the like, might be erroneously determined to be a drop. Thus, the drop can be detected with superior accuracy.

Fifth Embodiment

Figure 9:
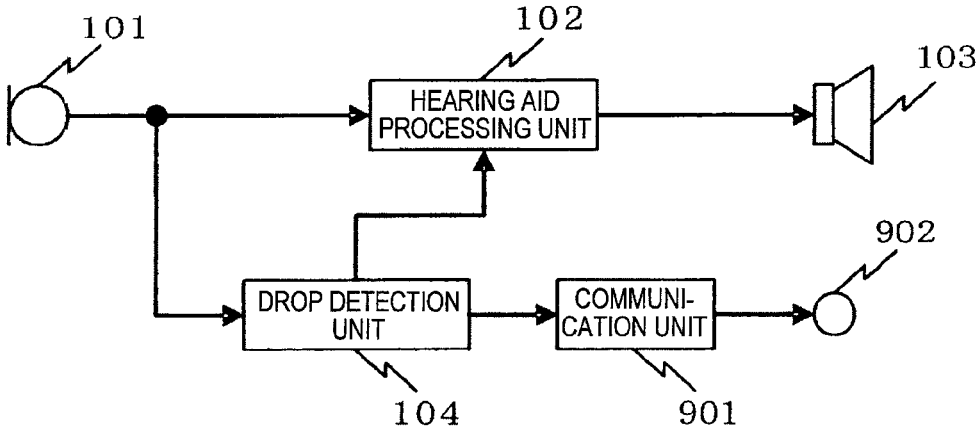
FIG. 9 is a block diagram showing a hearing aid of a fifth embodiment of the present invention.
Figure 10:
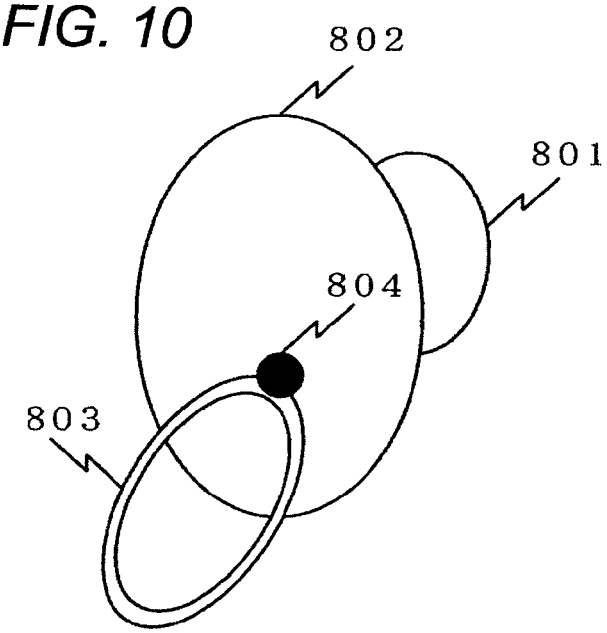
FIG. 10 is a perspective view of a related art hearing aid.

FIG. 9 is a block diagram of a hearing aid of a fifth embodiment of the present invention. In FIG. 9, constituent elements that are the same as those shown in FIG. 1 are assigned the same reference numerals, and their explanations are omitted. In FIG. 9, in addition to including the configuration of the hearing aid of the first embodiment of the present invention, the hearing aid includes a communication unit 901 and an output terminal 902.

Operation of the hearing aid of the fifth embodiment of the present invention is now described.

A method for detecting the drop of the hearing aid is the same as the method described in connection with the first embodiment of the present invention, and hence its explanation is omitted. Operation of the hearing aid following detection of the drop of the hearing aid is hereunder described.

When the drop of the hearing aid is detected by the drop detection unit 104, the drop detection unit 104 sends to the communication unit 901 a signal showing detection of the drop of the hearing aid. The communication unit 901 transmits a signal showing that the hearing aid dropped to another previously-determined device by way of the output terminal 902.

A preferred transmission mode for this case is radio communication. The other device received the signal showing the drop of the hearing aid notifies the user of the drop of the hearing aid by use of information, such as a picture, an image, a character, light, sound, and vibrations. A device to which a signal showing the drop of the hearing aid is to be transmitted may be of any type, so long as the device has means that enables receipt of drop information from the hearing aid and that notifies the user of the drop of the hearing aid.

As mentioned above, the hearing aid of the fifth embodiment of the present invention detects the drop of the hearing aid itself by use of the audio feedback sound and the impulsive sound and transmits a signal showing the drop of the hearing aid to another device to notify the device of the drop, whereby the drop of the hearing aid itself can be notified to the user by way of another device. Consequently, it is possible to reduce the possibility of loss of the hearing aid without imposing inconvenience to the user.

The hearing aid of the fifth embodiment of the present invention detects the drop of the hearing aid by use of the impulsive sound which results from the drop of the hearing aid as well as sound of the phenomenon (audio feedback) unique to the hearing aid. Therefore, a compact, economical hearing aid can be provided without use of a dedicated sensor, such as an impact sensor and an acceleration sensor.

The hearing aid of the fifth embodiment of the present invention uses presence or absence of the audio feedback sound as well as the impulsive sound for detecting the drop of the hearing aid. It is thereby possible to reduce the possibility that impulsive sound which would be produced when the hearing aid fitted into the ear is tapped simply with a finger, or the like, might be erroneously determined to be a drop. Thus, the drop can be detected with superior accuracy.

In the present embodiment, the communication unit 901 has been described as transmitting a signal showing the drop of the hearing aid to another device. However, there may also be adopted a configuration for receiving a signal from a GPS (Global Positioning System) satellite and transmitting associated information, such as a time and position where the hearing aid dropped, to another device, thereby notifying the user of the drop.

Although the hearing aids of the respective embodiments of the present invention have been described by reference to example integral-type hearing aids that integrally include the speaker and the microphone and that are to be fitted into the ear. The hearing aid may be of any type, so long as the hearing aid is fitted to the ear in the form of, such as inserting the hearing aid into an ear hole or attaching the hearing aid to an ear pinna.

Although the embodiments relating to implementation modes of the present invention have been described, the present invention is not limited to items described in connection with the embodiments. The present invention is scheduled to be modified or applied by artisans according to the descriptions of the present patent application and the well-known techniques. The modifications and applications shall fall within a range in which protection is sought.

Although the present invention has been described in detail by reference to the specific embodiments, it is manifest to those skilled in the art that the present invention will be susceptible to various alterations or modifications without departing a spirit and scope of the present invention.

The present invention is based on Japanese Patent Application (Application No. 2008-181735) filed on Jul. 11, 2008, the entire subject matter of which is incorporated herein by reference.

INDUSTRIAL APPLICABILITY

The hearing aid of the present invention yields an advantage of the ability to reduce the possibility of loss when compared with a related art hearing aid and is useful, as an acoustic device that reduces the possibility of loss, in various acoustic devices including a microphone and a speaker in an integrated fashion.

DESCRIPTION OF REFERENCE SIGNS

101 MICROPHONE
102 HEARING AID PROCESSING UNIT
103 SPEAKER
104 DROP DETECTION UNIT
201 INPUT TERMINAL
202 IMPULSIVE SOUND DETECTION UNIT
203 AUDIO FEEDBACK DETECTION UNIT
204 DROP DETERMINATION UNIT
205 OUTPUT TERMINAL
301 NOTIFICATION UNIT
302 ADDER
401 NOTIFICATION UNIT
501 MICROPHONE
502 DROP DETECTION UNIT
601 INPUT TERMINAL
602 INPUT TERMINAL
603 DIRECTIVITY SYNTHESIS UNIT
701 INPUT TERMINAL
702 INPUT TERMINAL
703 SUBTRACTOR
704 FILTER UNIT
705 OUTPUT TERMINAL
801 EAR HOLE INSERT UNIT
802 MAIN BODY
803 CORD
804 CONNECTION PORTION
901 COMMUNICATION UNIT
902 OUTPUT TERMINAL

The invention claimed is:

1. A hearing aid comprising:
a microphone;
a hearing aid processing unit configured to perform hearing aid processing to a signal corresponding to sound collected by the microphone, and produce an output signal;
a speaker configured to output sound generated from the output signal to an outside; and
a drop detection unit comprising:
an impulsive sound detection unit configured to detect impulsive sound due to the drop of the hearing aid via the microphone; and
an audio feedback detection unit configured to detect audio feedback sound caused by the microphone and the speaker;
wherein the drop detection unit detects the drop of the hearing aid based on an analysis of a signal corresponding to the impulsive sound and a signal corresponding to the audio feedback sound, and
wherein the drop detection unit comprises a drop determination unit configured to determine whether the hearing aid is dropped, based on a relationship between a detection time of the impulsive sound detected by the impulsive sound detection unit and a detection time of the audio feedback detected by the audio feedback detection unit.

2. The hearing aid according to claim 1, wherein the drop determination unit is configured to determine the hearing aid is dropped when a time between the detection time of the impulsive sound and the detection time of the audio feedback is within a predetermined time.

3. A hearing aid comprising:

a microphone;

a hearing aid processing unit configured to perform hearing aid processing to a signal corresponding to sound collected by the microphone, and output an output signal;

a speaker configured to output sound generated from the output signal to an outside;

an impulsive sound detection unit configured to detect impulsive sound corresponding to the drop of the hearing aid via the microphone and output a first signal related to the impulsive sound;

an audio feedback detection unit configured to detect audio feedback sound caused by the microphone and the speaker and output a second signal related to the feedback sound; and a drop determination unit configured to detect the drop of the hearing aid based on the first signal and the second signal.

4. The hearing aid according to claim 3, wherein the drop determination unit is configured to determine the hearing aid is dropped when a time between the detection time of the impulsive sound and the detection time of the audio feedback is within a predetermined time.

5. The hearing aid according to claim 3, wherein the hearing aid processing unit produces a warning sound from a signal of audio feedback in a case in which the drop determination unit detects the drop of the hearing aid.

6. The hearing aid according to claim 3, further comprising:

a notification unit configured to notify a user of the drop of the hearing aid according to a detection result of the drop determination unit.

* * * * *